United States Patent [19]

Kobayashi

[11] Patent Number: 4,880,231

[45] Date of Patent: Nov. 14, 1989

[54] ACTION TOY GAME APPARATUS

[75] Inventor: Toshio Kobayashi, Chiba, Japan

[73] Assignee: Asahi Corporation, Tokyo, Japan

[21] Appl. No.: 273,223

[22] Filed: Nov. 18, 1988

[30] Foreign Application Priority Data

Nov. 19, 1987 [JP] Japan ..... 62-176690[U]

[51] Int. Cl.[4] ..... A63F 9/06

[52] U.S. Cl. ..... 273/1 GD; 273/1 GF

[58] Field of Search ..... 273/1 GC, 1 GD, 1 GF, 273/1 GE, 140

[56] References Cited

U.S. PATENT DOCUMENTS

| | | | |
|---|---|---|---|
| 3,710,455 | 1/1973 | Liversidge et al. | 273/1 GF X |
| 4,229,003 | 10/1980 | Shimizu | 273/1 GG X |
| 4,306,717 | 12/1981 | Todokoro | 273/1 GG X |
| 4,366,957 | 1/1983 | Aldcroft et al. | 273/1 GF |
| 4,432,544 | 2/1984 | Wakimura | 273/140 X |

*Primary Examiner*—Paul E. Shapiro

*Attorney, Agent, or Firm*—Salter & Michaelson

[57] ABSTRACT

An action-toy game apparatus includes a base, a timer in the base, a rotatable platform on the base, a plurality of game elements, a retrieving mechanism, a receiving member, an upsetting mechanism and a tethered character figure. The timer is actuatable for a set period of time and the platform is operatively connected to the timer so that it rotates during the set period of time. The game elements are positionable on the platform and they are magnetically retrievable therefrom and repositionable in the receiving member with the retrieving mechanism during the set period of time. The upsetting mechanism is operative for upsetting any game elements remaining on the platform upon the expiration of the set period of time and the tethered character figure is operatively connected to the timer so that it is drawn toward the base during the set period of time.

3 Claims, 5 Drawing Sheets

ACTION TOY GAME APPARATUS

BACKGROUND AND SUMMARY OF THE INVENTION

The instant invention relates to amusements games and more particularly to an action toy game apparatus which is operative in connection with an amusement game of the general type wherein a game player must effectively and skillfully perform certain predetermined manipulative activities within a set period of time in order to achieve a game score.

Games of the type wherein game players must effectively perform certain manipulative activities within set periods of time in order to achieve game scores have generally been found to have relatively high levels of amusement value. Further, games of this type which require the use of game apparatus which incorporate amusing game themes and require game players to skillfully perform interesting types of activities have been found to be particularly popular. Still further, it has been found that games of this general type which are specifically adapted for use by young children can aid in the development of manual dexterity and hand-to-eye coordination. Game apparatus of this general type are disclosed in the assignee's copending U.S. patent application Ser. Nos. 129,822; 129,823; and, 129,824 and U.S. Pat. No. 4,783,074.

The instant invention provides a highly effective and amusing toy-game apparatus which is adapted for use in connection with a novel and amusing game wherein a game player must perform predetermined manipulative game activities within a set period of time in order to achieve a game score. In particular, the action toy-game apparatus of the instant invention comprises a base, a timer in the base which is actuatable for a set period of time, a rotatable platform on the base which is operatively connected to the timer for rotation during the set period of time, a plurality of game elements which are receivable on the platform and a retrieving mechanism which is operative for individually retrieving the game elements from the platform during the set period of time. The retrieving mechanism is preferably adapted for magnetically retrieving the game elements from the platform during the set period of time, and hence one of either the retrieving means or each of the game elements comprises magnetic means thereon, and the other of either the retrieving or each of the game elements is magnetically responsive so that the game elements can be magnetically retrieved from the platform. The game elements are preferably receivable in upright positions on the platform and they are preferably adapted so that they are only retrievable when they are in the upright positions thereof. The game apparatus preferably further comprises means for upsetting any of the game elements remaining in the upright positions thereof on the platform upon the expiration of the set period of time and a tethered character figure which is operatively connected to the timer so that it is drawn toward the base during the set period of time and positioned at a location which is closely adjacent to the base upon the expiration of the set period of time. The apparatus preferably still further comprises a receiver for receiving the game elements from the retrieving mechanism, and the retrieving mechanism is preferably pivotable about an axis which is substantially parallel to the axis of rotation of the platform so that it can be effectively utilized to retrieve game elements from various positions on the platform as the platform is rotated during the set period of time. The retrieving mechanism preferably further includes a retrieving arm which is manually movable to a lowered position for retrieving the game elements from the platform, and either the magnetic means or the magnetically responsive means is preferably mounted on the outer end of the retrieving arm.

Accordingly, for use and operation of the game apparatus of the instant invention, the game elements are positioned in the upright positions thereof on the platform, and the timer is actuated for a set period of time. Upon actuation of the timer, the platform commences rotation and the game elements can be individually retrieved from the platform by properly positioning the retrieving arm and moving it to a lowered position in order to individually magnetically retrieve the game elements. After a game element has been retrieved from the platform with the retrieving arm, it can be moved to the receiving member; and, thereafter, another game element can be retrieved in a similar manner. However, once the set period of time has expired, any game elements remaining in the upright positions thereof on the platform are automatically upset, and rotation of the platform is terminated.

Accordingly, it is a primary object of the instant invention to provide an effective and amusing action toy game apparatus of a type wherein certain predetermined manipulative activities must be performed within a set period of time in order to achieve a game score.

Another object of the instant invention is to provide an effective action toy game apparatus which is adapted to incorporate a novel and amusing game theme.

An even further object of the instant invention is to provide an effective action toy game apparatus which is adapted to be used by young children in order to aid in the development of hand-to-eye coordination and manual dexterity.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
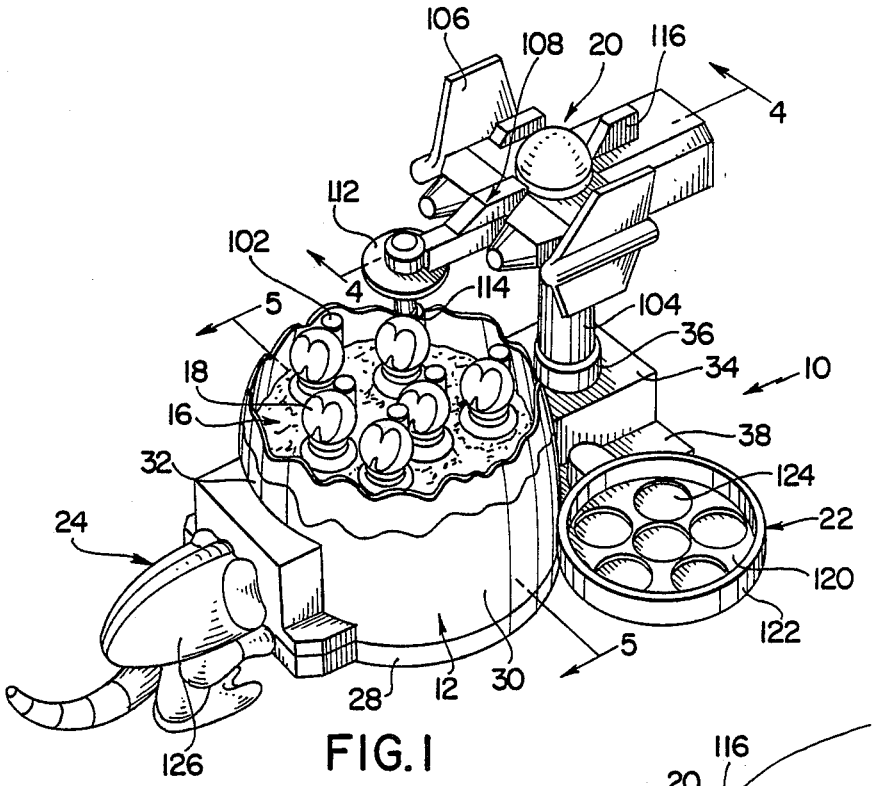
FIG. 1 is a perspective view of the action toy game apparatus of the instant invention with the game elements positioned in the upright positions thereof of the platform.
Figure 2:
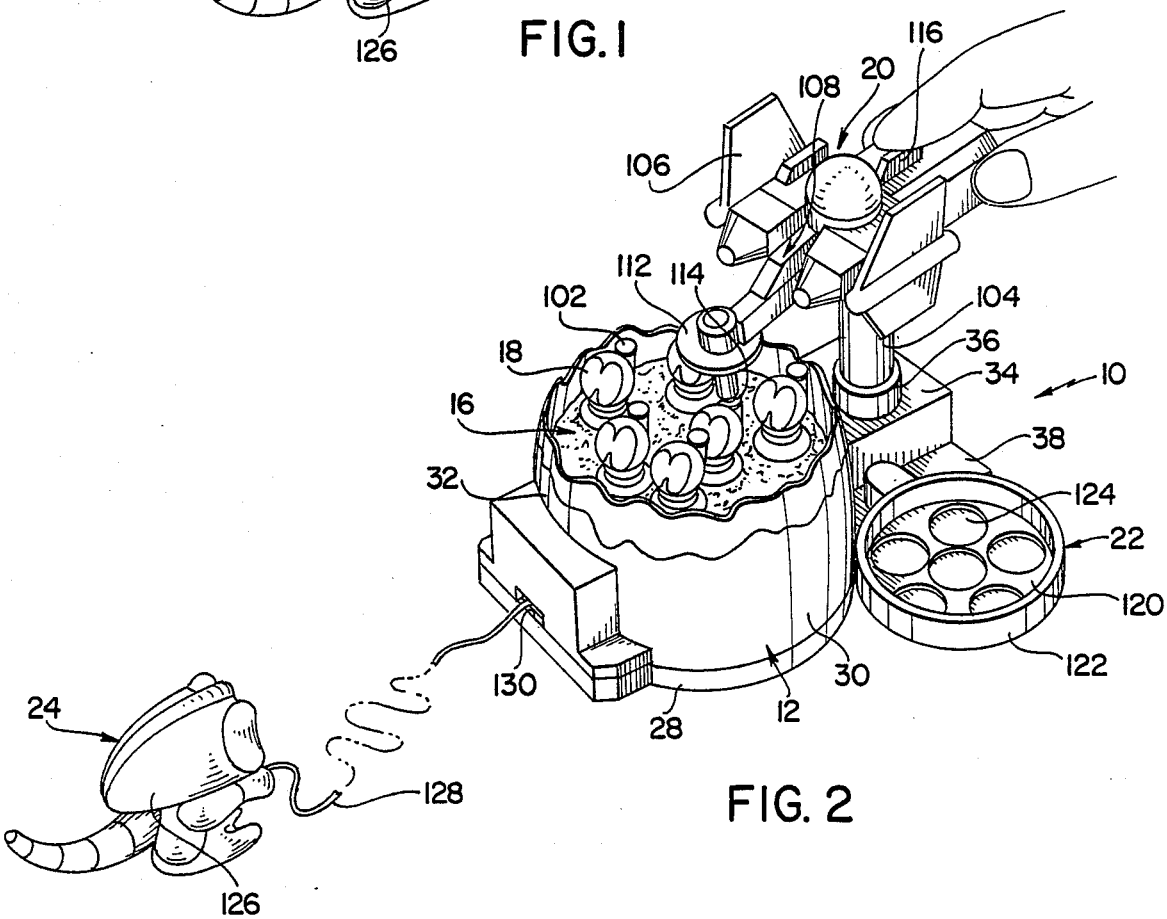
FIGS. 2 and 3 are similar perspective views illustrating the operation of the retrieving mechanism.
Figure 3:
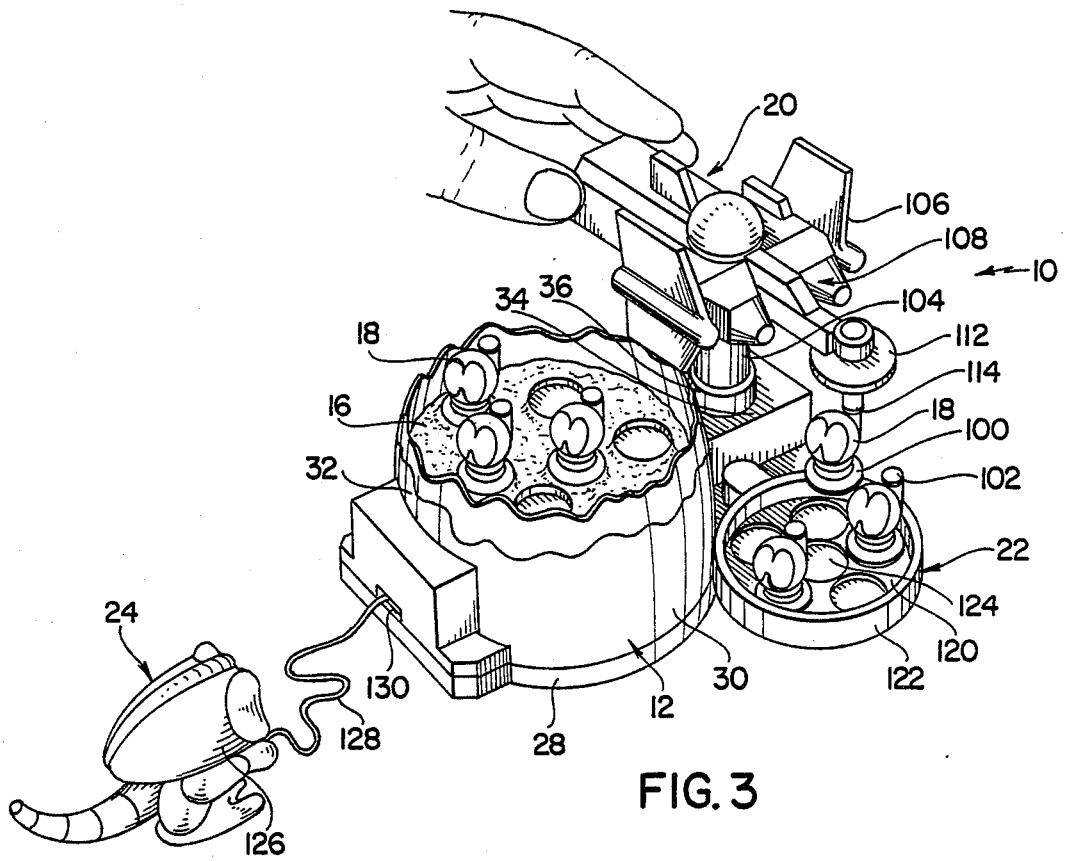
Figure 4:
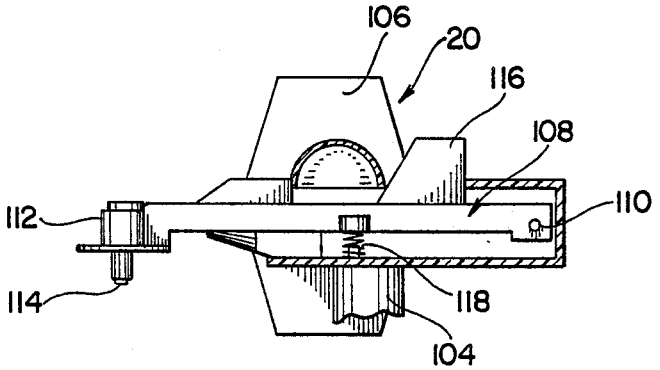
FIG. 4 is a sectional view taken along line 4—4 in FIG. 1.

Referring now to the drawings, the action toy game apparatus of the instant invention is illustrated and generally indicated at 10 in FIGS. 1–3. The action toy game apparatus 10 comprises a base generally indicated at 12, a timer generally indicated at 14 (see FIGS. 5–10), a platform assembly generally indicated at 16, a plurality of game elements generally indicated at 18, a retrieving mechanism generally indicated at 20, a receiving member generally indicated at 22, a tethered character figure generally indicated at 24, and an upsetting mechanism generally indicated at 26. The timer 14 is mounted in the base 12, and the platform mechanism 16 is mounted on the base 12 and operatively connected to the timer 14 so that it rotates when the timer 14 is an actuated condition. The game elements 18 are receivable on the platform 16 in the upright positions thereof illustrated in FIGS. 1–3, and the retrieving mechanism 20 is operative for retrieving the game elements 18 from the platform mechanism 16 and for positioning them in the receiving member 22. The tethered character FIG. 24 is operatively connected to the timer 14 so that it is drawn toward the base 12 when the timer 14 is in an actuated condition, and it is adapted so that the character FIG. 24 is positioned in closely adjacent relation to the base 12 when the timer reaches the unwound position thereof. The upsetting mechanism 26 is operatively connected to the timer 14 so that it strikes the underside of the platform mechanism 16 in order to upset any game elements 18 remaining thereon when the timer 14 reaches the unwound position thereof. Accordingly, for use and operation of the game apparatus 10, the game elements 18 are positioned in the upright positions thereof on the platform mechanism 16, and the timer 14 is set for a predetermined period of time. As the timer 14 is advanced toward the unactuated or unwound position thereof, the platform mechanism 16 rotates on the base 12, and the tethered character FIG. 24 is drawn toward the base 12. As the platform mechanism 16 is rotated, the game elements 18 thereon can be retrieved from the platform mechanism 16 utilizing the retrieving mechanism 20, so that the game elements 18 can be positioned on the receiving member 22. However, when the timer 14 reaches the unactuated or unwound position thereof, rotation of the platform mechanism 16 is terminated, and the upsetting mechanism 26 sharply engages the underside of the platform mechanism 16 in order to upset any game elements 18 remaining thereon. Accordingly, once the timer 14 has reached the unactuated position thereof, it is no longer possible to retrieve the game elements 18 from the platform mechanism 16 with the retrieving mechanism 20.

The base 12 is preferably made of a suitable plastic material and it comprises a lower plate portion 28, and an upper housing portion 30 which is received on the plate portion 28 so that it cooperates therewith to define a housing for containing the timer 14 and the upsetting mechanism 26. The upper housing portion 30 includes a substantially circular shell portion 32 in which the timer 14, the upsetting mechanism 26 and the platform mechanism 16 are mounted, and a retrieving mechanism support portion 34 on which the retrieving mechanism 20 is mounted. The retrieving mechanism support portion 34 includes an upwardly extending tubular sleeve 36 in which the retrieving mechanism 20 is rotatably supported as will hereafter be more fully set forth, and a receiving mechanism support platform 38 is integrally formed with the retrieving mechanism support portion 34.

Figure 8:
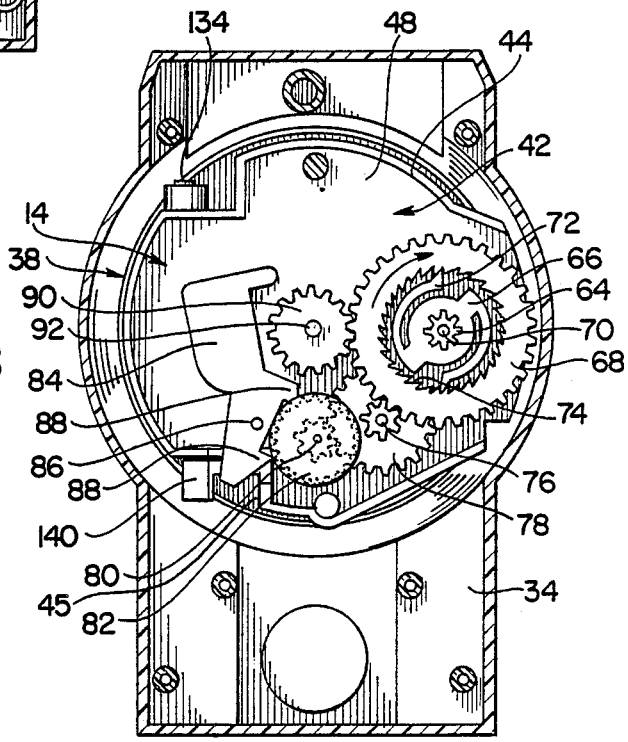
FIG. 8 is a sectional view taken along line 8—8 in FIG. 5.
Figure 9:
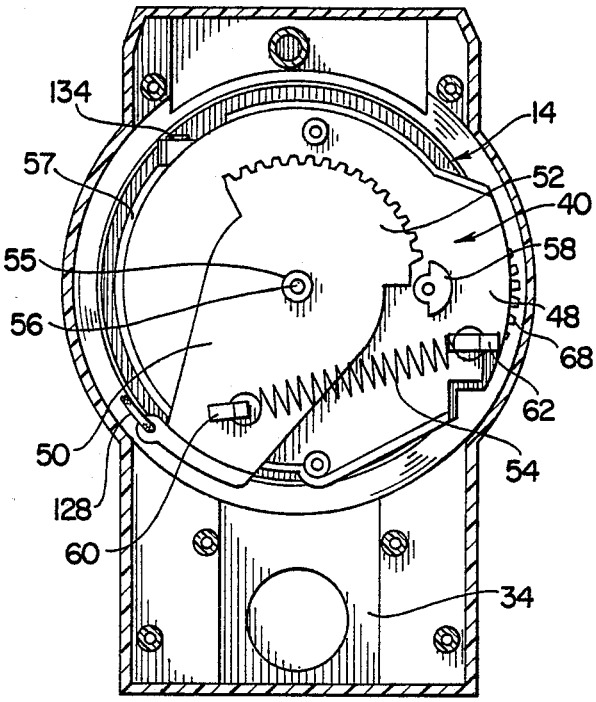
FIG. 9 is a sectional view taken along line 9—9 in FIG. 5.
Figure 10:
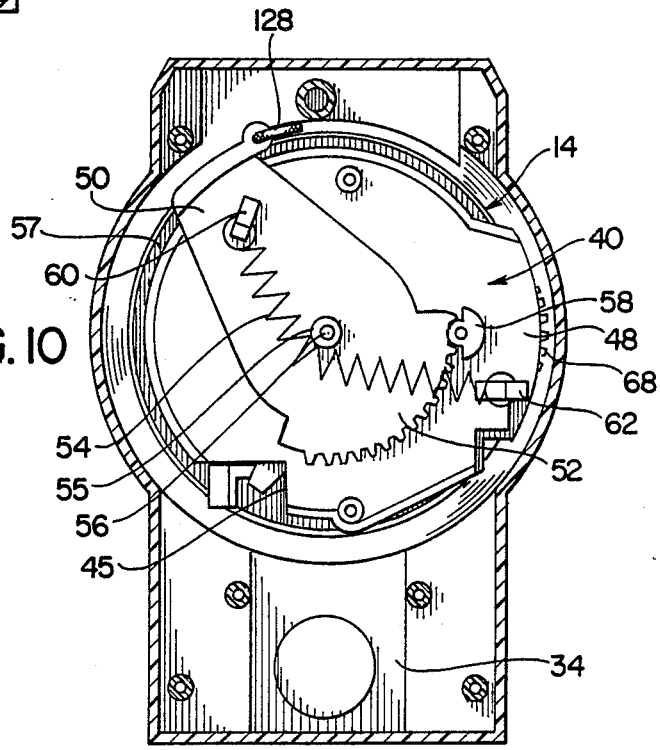
FIG. 10 is a similar sectional view with the timer in the fully wound position thereof.

The timer 14 is illustrated most clearly in FIGS. 8–10, and it includes an outer housing generally indicated at 38, a winding mechanism generally indicated at 40, and a decay mechanism generally indicated at 42. The housing 38 is preferably made of a suitable plastic material and it includes an upper housing section 44 having a peripheral notch 45 therein, a lower housing section 46, and a partition 48 which separates the upper and lower housing sections 44 and 46 As illustrated in FIGS. 8–10, the decay mechanism 42 is contained in the upper housing section 44, and the winding mechanism 40 is contained in the lower housing section 46.

Referring now to FIGS. 9 and 10, the winding mechanism 40 is illustrated. The winding mechanism 40 comprises a winding arm 50 which is integrally formed with an arcuate fan gear 52 and a winding spring 54. The winding arm 50 includes a center hub 55 which is rotatably received on a shaft 56 on the partition 48 and it is movable between the unwound position thereof illustrated in FIG. 9 and the wound position illustrated in FIG. 10. The winding arm 50 is further adapted so that the outer end thereof travels in a slot 57 in the housing 38 as it is moved between the wound and unwound positions thereof. The fan gear 52 is concentrically oriented with respect to the shaft 56, and it is adapted so that it passes through an open gear housing 58 on the partition 48 as the winding arm 50 is moved between the wound and unwound positions thereof. However, the fan gear 52 is further formed so that it passes completely through the gear housing 58 slightly before the winding arm 50 reaches the fully unwound position thereof. The spring 54 extends between a first lug 60 on the winding arm 50 and a second lug 62 on the partition 48, and it is operative for biasing the winding arm 50 toward the unwound position thereof. In this connection, as illustrated in FIG. 10, when the winding arm 50 is in the fully wound position thereof, the spring 54 is in a position wherein it extends around the hub 55 in order to more effectively bias the winding arm 50 toward the unwound position thereof. An engagement lug 63 is also formed on the upper side of the winding arm 50 adjacent the outer end thereof.

Referring now to FIG. 8, the decay mechanism 42 is illustrated. The decay mechanism 42 comprises a main drive gear 64 which is integrally formed with a ratchet ring 66, and a main transmission gear 68. The main drive gear 64 and the ratchet ring 66 are rotatably mounted on a shaft 70 so that the main drive gear 64 is positioned in the open gear housing 58 and driven by the fan gear 52 as the winding mechanism is advanced toward the unwound position. The ratchet ring 66 includes a pair of resilient ratchet arms 72, and it is received in a circular recess 74 having peripheral teeth therein in the main transmission gear 68. In this connection, as illustrated in FIG. 8, the ratchet ring 66 is formed so that the ratchet arms 72 engage the teeth in the recess 74 in order to rotate the main transmission gear 68 in the direction illustrated. However, when the main transmission gear 70 and the ratchet ring 66 are rotated in a reverse direction, the ratchet arms 72 pass over the teeth in the recess 74 so that rotation cannot be communicated to the main transmission gear 68 in the reverse direction. The main transmission gear 68 intermeshes with a reduced intermediate transmission gear 76 which is integrally formed with an enlarged intermediate transmission gear 78. The reduced and enlarged intermediate transmission gears 76 and 78, respectively, are rotatably mounted on a common shaft so that they rotate as the main transmission gear 68 is rotated in the direction illustrated, and the enlarged intermediate transmission gear 78 intermeshes with an escapement wheel gear 80. The escapement wheel gear 80 is integrally formed with an escapement wheel 82 having a plurality of peripheral V-shaped teeth thereon, and the escapement wheel drive gear and the escapement wheel 82 are mounted on a common shaft on the partition 48. The decay mechanism 42 further comprises an escapement arm 84 which is pivotably mounted on a shaft 86. The escapement arm 84 includes a pair of opposed jaws 88, and it is adapted and positioned so that as the escapement wheel 82 is rotated, the jaws 88 alternately pass from tooth to tooth on the escapement wheel 82 to cause the escapement arm 84 to oscillate back and forth. As a result, the escapement arm 84 and the escapement wheel 82 cooperate to control the rate of rotation on the gears 80, 78, 76, 68 and 70 so that the winding arm 50 is advanced toward the unwound position thereof at a controlled rate by the spring 54. The escapement arm 84 is also operative for producing a ticking sound as the jaws 88 alternately pass from tooth to tooth on the escapement wheel 82. Also included in the decay mechanism 42 is a platform drive gear 90 which is mounted on a shaft 92 and positioned so that it intermeshes with the main transmission gear 68. Accordingly, as the main transmission gear 68 is rotated in the direction illustrated, the shaft 92 which extends upwardly through the partition 48 is also rotated.

The platform assembly 16 comprises a substantially circular platform element 94 which is received in a substantially horizontal disposition in the main housing section 30. A hub 96 extends downwardly from the platform element 94 and is received on the shaft 92 so that the platform element 94 rotates with the shaft 92. A plurality of substantially circular recesses 98 are formed in the upwardly facing surface of the platform element 94.

The game elements 18 are preferably formed as small imaginary character figures, and each includes a substantially flat, circular bottom disk 100 which is dimensioned to be received in one of the recesses 98 in the upper surface of the platform element 94. Each of the game elements 18 further includes a magnetically responsive, upwardly facing metallic element 102.

The retrieving mechanism 20 is illustrated in FIGS. 1–4 and it includes a pedestal portion 104 which is rotatably received in the sleeve 36 of the base 12. Integrally formed at the upper end of the pedestal portion 104 is a main body portion 106 which, in the embodiment herein set forth, is configured to resemble a space craft. A retrieving arm 108 is pivotably mounted in the body portion 106 at 110, and it includes a retrieving end portion 112 having a downwardly facing magnetic element 114 thereon. The arm 108 also includes an upwardly extending button portion 116, and it is biased to the substantially horizontally extending position illustrated in FIG. 4 with a spring 118. However, by depressing the button portion 116, the arm 108 is downwardly pivotable so that the magnetic element 114 is moved downwardly. Accordingly, by positioning the magnetic element 114 over the magnetically responsive element 102 on one of the game elements 18 and then depressing the button portion 16 so that the magnetic element 114 is moved into engagement with the magnetically responsive element 102 of the game element 18, the game element 18 can be retrieved with the retrieving arm 108. Further, by thereafter rotating the retrieving mechanism 20 in the sleeve 36, the game element 18 can be repositioned in the manner illustrated in FIG. 3 and by either sharply depressing the button portion 16 or by positioning the game element 18 in the receiving member 22 and then further rotating the retrieving mechanism 20, the game element 18 can be disengaged from the retrieving mechanism 20.

The receiving member 22 is pivotably mounted on a post (not shown) which is integrally formed on the receiving member support platform 38, and it comprises a substantially circular bottom wall 120 and a peripheral sidewall 122 which extends around the perimeter of the bottom wall 120. Formed in the bottom wall 120 is a plurality of substantially circular recesses 124 which are dimensioned for receiving the bottom disks 100 of the game elements 18 therein in the manner illustrated in FIG. 3. In this connection, by rotating the receiving member 22 about the axis of the post (not shown) on the receiving member support platform 38 and by rotating the retrieving member 20 in the sleeve 36, the game elements 18 which are retrieved with the retrieving mechanism 20 can be aligned with the recesses 124 so that they can be placed in the different recesses 124 in the receiving member 22.

The tethered character figure mechanism 24 comprises a character figure element 126 and a cord 128. As herein embodied, the character figure element 126 is formed in the configuration of an imaginary alien character, and it is attached to the timer 14 with the cord 128. In this connection, the cord 128 preferably comprises a flexible cord element, and it extends through an opening 130 in the base 12. As illustrated most clearly in FIG. 7, after the cord 128 passes through the opening 130, it passes around a rotatable spool 132 on the bottom plate portion 28 of the base 12 and it extends around the timer 14 to the winding arm 50 where it is attached to the timer 14. Accordingly, by pulling on the cord 128, the winding arm 50 can be moved to the wound position thereof illustrated in FIG. 10; and as the winding arm 50 is advanced toward the unwound position thereof, the cord 128 is drawn inwardly into the base 12 through the opening 130. In this connection, the cord 128 is preferably dimensioned so that when the timer 14 reaches the fully unwound position thereof, the character figure element 126 is positioned in closely adjacent relation to the base 12 as illustrated in FIG. 1.

Figure 5:
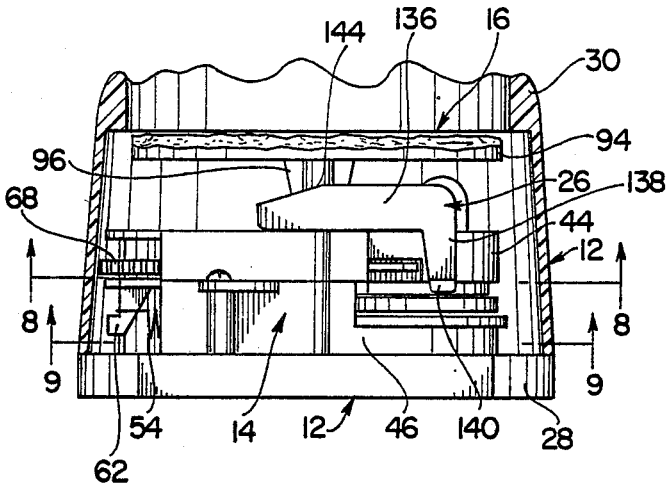
FIG. 5 is a sectional view taken along line 5—5 in FIG. 1.
Figure 6:
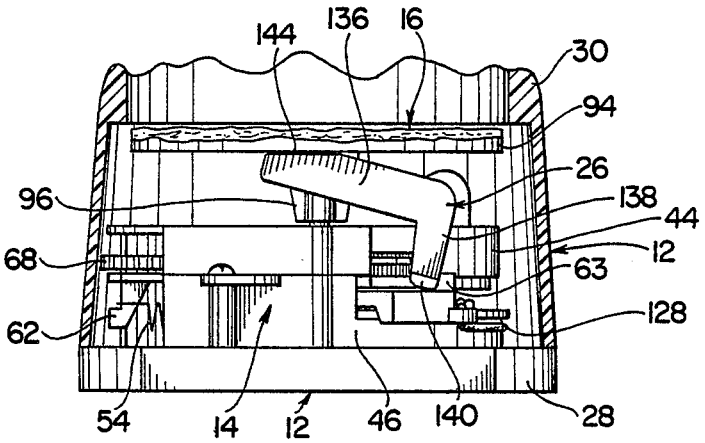
FIG. 6 is a similar sectional view illustrating the operation of the upsetting mechanism.
Figure 7:
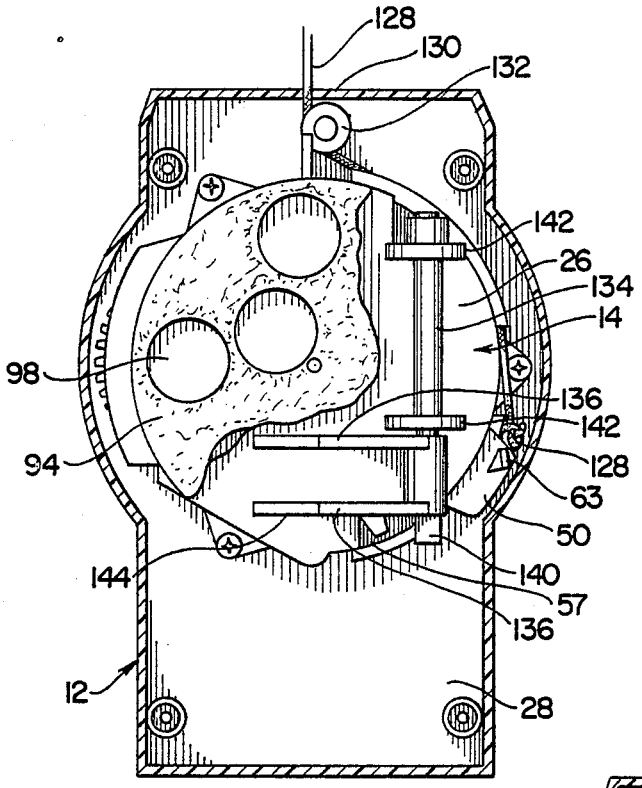
FIG. 7 is a fragmentary top plan view of the apparatus with the retrieving mechanism and the main housing section removed.

Referring now to FIGS. 5–7, the upsetting mechanism 26 is illustrated. The upsetting mechanism 26 comprises a shaft 134 having a pair of hammer elements 136 thereon and a downwardly extending leg 138 which terminates in an outwardly extending foot 140. The shaft 134 is rotatably mounted in a pair of mounts 142 which are integrally formed on the upper wall of the upper timer housing section 44. The hammer elements 136 are integrally formed with the shaft 134, and they have angular edge surfaces 144 thereon. The hammer elements 136 are normally gravitationally retained in the position illustrated in FIG. 5 wherein they are in engagement with the upper surface of the upper housing section 44. However, the hammer elements 136 are engageable with the underside of the platform member 94 by rotating the shaft 134 in the manner illustrated in FIG. 6. In this connection, the angular edge surfaces 144 are oriented so that when the shaft 134 is pivoted to cause the hammer elements 136 to engage the platform element 94, the edge surfaces 144 meet the underside of the platform element 94 in substantially face-to-face engagement as illustrated in FIG. 6. The leg 138 extends downwardly from the shaft 134 into the notch 45 in the upper timer housing section 44, and the foot 140 extends outwardly from the lower end of the leg 138. The leg 138 is positioned in a substantially vertical disposition when the hammer elements 136 are in overlying engagement on the upper side of the upper housing section 44 as illustrated in FIG. 5. When the leg 138 is in this position, the foot 140 is engageable by the lug 63 on the upper side of the winding arm 50 just before the winding arm 50 reaches the fully unwound position thereof. In this regard, because the fan gear 52 passes completely through the gear housing 58 before the winding arm 50 reaches the fully unwound position thereof, it is disengaged from the main drive gear 64 before the winding arm 50 reaches the fully unwound position thereof. Accordingly, once the fan gear 52 passes through the open gear housing 58, the winding arm 50 is no longer restrained by the decay mechanism 42 so that the lug 63 is propelled into engagement with the foot 140. This causes the foot 140 to be rapidly advanced toward the position illustrated in FIG. 6, and it also causes the hammer elements 136 to be rapidly moved upwardly so that they sharply engage the underside of the platform element 94. The shock produced by the engagement of the hammer elements 136 with the platform element 94 causes any of the game elements 18 remaining in the upright position thereof in the recesses 98 to be jarred sufficiently so that they are upset from the upright positions thereof. Accordingly, when the timer 14 reaches the fully unwound position thereof, any remaining game elements 18 on the platform mechanism 16 are upset by the upsetting mechanism 26 so that the magnetically responsive elements 102 on the game elements 18 can no longer be engaged by the magnetic element 114 on the retrieving arm 108.

Accordingly, for use and operation of the toy-game apparatus 10, the game elements 18 are positioned on the platform mechanism 16 so that the lower disk portions 100 thereof are received in the recesses 98. Thereafter, the character figure element 126 is moved away from the base 12 so that the cord 128 is pulled outwardly through the opening 130 and the timer 14 is moved to the wound position illustrated in FIG. 10. When the character figure element 126 is thereafter released, it is drawn toward the base 12 with the cord 128, and the platform mechanism 16 is rotated by the timer 14. As the platform mechanism 16 is rotated, the retrieving mechanism 20 can be manually operated to retrieve the game elements 18 from the platform mechanism 16. In this connection, in order to retrieve the game elements 18, the retrieving mechanism 20 must be rotated in the neck portion 36 to position the magnetic element 114 over the magnetically responsive element 102 of one of the game elements 18. The button element 16 must then be depressed so that the magnetic element 114 engages the magnetically responsive element 102 to enable the game element 18 to be lifted from the platform mechanism 16 utilizing the magnetic attraction between the magnetic element 114 and the magnetically responsive element 102. Once the game element 18 has been lifted from the platform mechanism 16 in this manner, it can be positioned over one of the recesses 124 in the receiving member 22 and then released into the receiving member 22 in the manner hereinabove set forth. The retrieving mechanism 20 can then be utilized for retrieving another game element 18 from the platform mechanism 16 in a similar manner. This procedure can then be repeated until the predetermined time period set by the timer 14 has expired. In this regard, upon the expiration of the time period, the engagement lug 63 on the winding arm 50 is propelled into engagement with the foot 140 to rapidly rotate the shaft 134 so that the hammer elements 136 sharply impact the underside of the platform element 94 causing any game elements 18 remaining on the platform element 94 to be jarred into upset positions thereon. During the entire set period of time, the character figure element 126 is drawn toward the base 12 with the cord 128; and upon the expiration of the set period of time, the character figure element 126 is positioned adjacent the base 12. Accordingly, the toy 10 is operative for a simulated action wherein the character figure element 126 crashes into the base 12 to upset the game elements 18. In any event, once the game elements 18 have been upset on the platform mechanism 16, they can no longer be retrieved with the retrieving mechanism 20 so that the game score of the game player is determined by the number of game elements 18 which have been retrieved and positioned in the receiving member 22 during the set period of time.

It is seen therefore that the instant invention provides an effective action toy-game apparatus. In this connection, game players utilizing the apparatus 10 must exercise a relatively high level of skill in order to retrieve the game elements 18 with the retrieving mechanism 20 as the game elements 18 are rotated on the platform mechanism 16. Further, the overall theme of the game apparatus 10 wherein the tethered character FIG. 126 is advanced toward the base 12 during the set time period adds an extra dimension of interest and excitement to the overall game play. Accordingly, it is seen that the toy-game apparatus of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An action toy-game apparatus comprising a base, a timer on said base actuable for a set period of time, rotatable platform means on said base operatively connected to said timer for rotation during said set period of time, a plurality of game elements receivable in upright positions on said platform means for rotation therewith during said set period of time, retrieving means for individually retrieving said game elements from said platform mean, one of either said retrieving means or each of said game elements comprising magnet means, the other one of either said retrieving means or each of said game elements comprising magnetically responsive means, said retrieving means being operative for individually magnetically retrieving said game elements from said platform means during rotation of said platform means, means for upsetting any game elements remaining on said platform means and positioned in the upright positions upon the expiration of said set period of time, and a tethered character figure which is operatively connected to said timer so that it is drawn toward said base during said set period of time and positioned at a location which is closely adjacent said base upon the expiration of said set period of time.

2. An action toy-game apparatus comprising a base, a timer on said base actuable for a set period of time, rotatable platform means on said base operatively connected to said timer for rotation during said set period of time, a plurality of game elements receivable on said platform means for rotation therewith during said set period of time, said game elements being positionable in upright positions on said platform means, means on said base for retrieving said game elements from said platform means during said set period of time, means for upsetting any game elements remaining on said platform means and positioned in the upright positions thereof upon the expiration of said set period of time, and a tethered action element which is operatively connected to said timer so that it is drawn toward said base during said set period of time and positioned at a location which is closely adjacent said base upon the expiration of said set period of time.

3. In the action toy-game apparatus of claim 2, said action element further characterized as a character figure.

* * * * *